United States Patent [19]

Dinneen

[11] Patent Number: 4,840,531

[45] Date of Patent: Jun. 20, 1989

[54] VEHICLE FOR CURBSIDE COLLECTION OF SOURCE SEPARATED RECYCLABLE MATERIALS

[75] Inventor: Maurice J. Dinneen, Scarborough, Canada

[73] Assignee: The Corporation of the City of Toronto, Toronto, Canada

[21] Appl. No.: 205,179

[22] Filed: Jun. 10, 1988

[51] Int. Cl.[4] ..... B65F 3/04

[52] U.S. Cl. ..... 414/409; 296/184; 298/18; 414/470

[58] Field of Search ..... 414/403, 404, 406, 408, 414/407, 409, 421, 422, 470; 298/18, 17.7; 296/183, 184; 105/248

[56] References Cited

U.S. PATENT DOCUMENTS

| | | | |
|---|---|---|---|
| 283,340 | 8/1883 | Greene | 298/18 |
| 1,013,789 | 1/1912 | Longest | 298/18 |
| 1,555,203 | 9/1925 | Hart | 105/248 |
| 1,763,499 | 6/1930 | Bolger | 414/409 |
| 2,906,557 | 9/1959 | Garabedian et al. | 296/184 |
| 3,101,974 | 8/1963 | Robertson et al. | 298/18 |
| 3,240,164 | 3/1966 | Flowers | 298/18 |
| 3,910,434 | 10/1975 | Ebeling et al. | 414/408 |
| 4,113,125 | 9/1978 | Schiller | 414/512 X |
| 4,219,298 | 8/1980 | Stragier et al. | 414/409 |
| 4,597,710 | 7/1986 | Kovats | 414/409 |

FOREIGN PATENT DOCUMENTS

| | | | |
|---|---|---|---|
| 3537546 | 4/1987 | Fed. Rep. of Germany | 414/512 |
| 25065 | 3/1981 | Japan | 298/18 |
| 156839 | 9/1984 | Japan | 298/17.7 |
| 1324890 | 7/1987 | U.S.S.R. | 298/18 |

OTHER PUBLICATIONS

Bodies and Hoists Brochure, The Heil Co., 27 pages, copyright 1924, pertinent page #19.

*Primary Examiner*—Frank E. Werner
*Assistant Examiner*—Robert S. Katz
*Attorney, Agent, or Firm*—Nixon & Vanderhye

[57] ABSTRACT

The disclosure herein describes a vehicle for curbside collection of source separated recyclable materials. A dumping unit includes a box-like frame having a series of compartments to receive the separated materials and includes, along one side wall thereof, a vertically movable trough having a series of compartments receiving the recyclable materials. The trough moves upwardly along the said side wall to an upper discharging position whereby the separated materials are dumped into the compartments of the frame. A cylinder located centrally between the understructure and the frame cooperates with pin-engaged hinge points on either side or rear of the frame to tilt the frame on any one side depending on where the pins are engaged in the hinge points. Doors at the bottom of each compartment allow the discharging of the contents of the compartments whenever the frame is tilted on one side or the other.

5 Claims, 3 Drawing Sheets

VEHICLE FOR CURBSIDE COLLECTION OF SOURCE SEPARATED RECYCLABLE MATERIALS

FIELD OF THE INVENTION

The present invention relates to a vehicle for curbside collection of source separated recyclable materials.

BACKGROUND OF THE INVENTION

Curbside source separation is one step in comprehensive waste control. In order to remove and to re-use as much material in the waste stream, separate collection of newspapers, glass bottles, plastic containers, metal cans and, ultimately other marketable materials, must be carried out with vehicles (trucks) of special construction capable of separately storing the collected materials.

One presently known truck consists of an enclosed compartmentalized body mounted on a low entry walk-in cab with dual left and right hand driving controls to facilitate the use of a one-person crew. Although this vehicle is capable of an adequate job, it has been found that the loading height on the side of the vehicle is too high, making it difficult for the collector to place the materials in the truck body.

Another known vehicle consists of a totally enclosed compartmentalized self-dumping unit installed on a standard chassis. The body is a steel structure with center hung adjustable partitions. The truck is equipped with an hydraulic lifting rail running the length of the body. Laterally movable metal boxes are secured to the rail and positioned in relationship to the partitions in the body. The collected materials are placed in the metal boxes and are mechanically lifted and emptied into the truck. When the loading rail reaches the top of the body, the roof opens at a 45° angle. The lifting rail continues over the top of the body and the boxes are dumped down into the body. This unit eliminates two of the disadvantages of existing recycling vehicles: the high loading height and the fixed vertical posts between the side hatches are avoided. However, one disadvantage of this unit is the heigth of the roof when it is in the open position and which is a source of problems because of low hanging wires and branches in streets. The discharging of the collection of the material on all known units is carried out by opening one or two rear panels, each compartment being discharged separately by removing sequentially the dividing walls defining the compartments. This operation requires a minimum of four backing-up manoeuvres.

OBJECT AND STATEMENT OF THE INVENTION

It is an object of the present invention to provide a vehicle for the curbside collection of source separated recyclable materials which overcomes the above problems associated with presently known vehicles.

It is also an object of the present invention to provide a vehicle where the discharging can be done on any one side or rear of the vehicle, with a minimum of truck movement.

The present invention thereby relates to a vehicle for curbside collection of source separated collection of recyclable materials which comprises: A vehicle for curbside collection of source separated collection of recyclable materials comprising:

a wheel-supported understructure having front and rear sections;

a driver compartment mounted to the front section of the understructure;

a dumping unit mounted to the rear section of the understructure; the unit including a box-like frame having front, rear and side walls and displaying therein a plurality of longitudinally spaced dividing walls defining a first series of compartments;

a vertically movable trough extending longitudinally of the frame along one side wall thereof; said trough displaying therein a plurality of longitudinally spaced dividing walls defining a second series of compartments to receive source separated recyclable materials;

means on the unit for vertically guiding the trough along the side wall; the guiding means allowing the trough to move to an upper discharging position whereby recyclable materials collected in each compartment of the trough are dumped into a corresponding compartment of the box-like frame;

actuatable means mounted between the box-like frame and the understructure for moving the frame relative to the understructure;

hinge points on the frame and the understructure, located at the lower portion of each side wall;

removable retaining means receivable in each hinge point and cooperating with the actuatable means to tilt the frame about those hinge points from which the retaining means are not removed; and latchable door means at the bottom of each compartment of the frame allowing the materials to be discharged when the frame is tilted.

In one form of the invention, the frame includes a top wall which is spaced from the top end of the frame a distance sufficient to allow the discharging of the trough into the first series of compartments.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
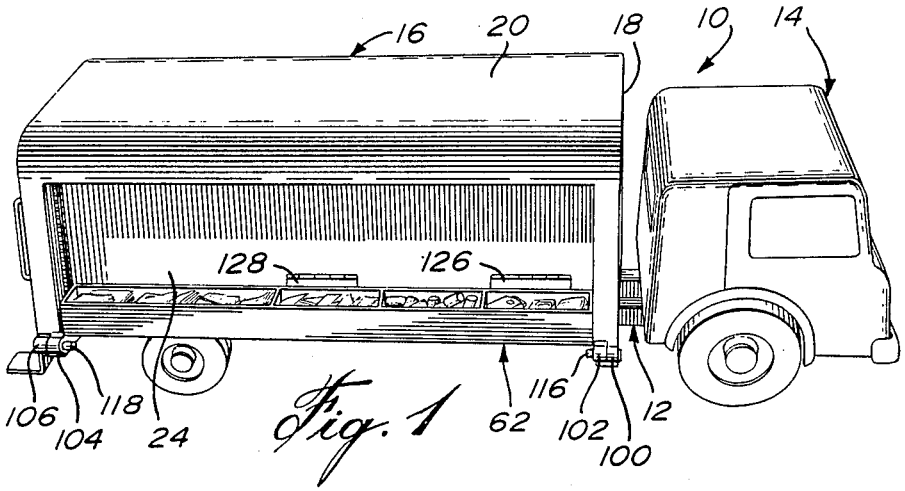
FIG. 1 is a top perspective view of a vehicle made in accordance with the present invention, showing the trough side of the vehicle.
Figure 2:
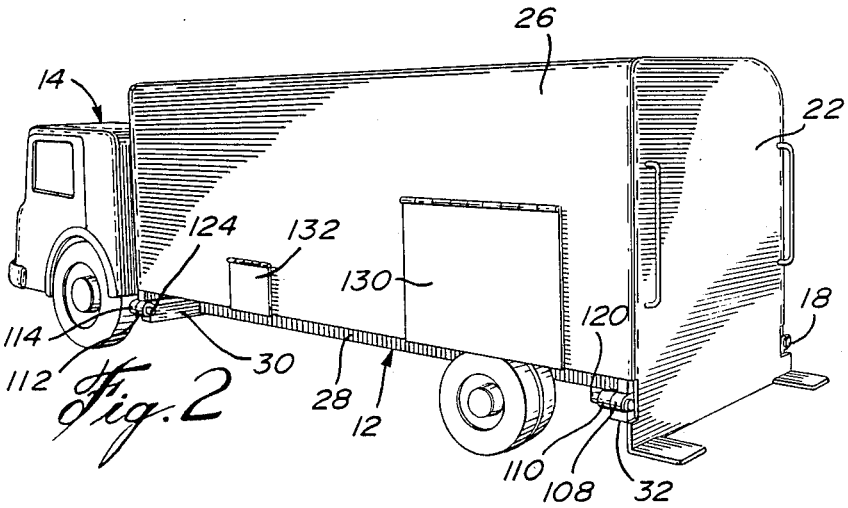
FIG. 2 is a perspective view of the vehicle of FIG. 1 showing the other side.

Referring to FIG. 1 and 2, there is shown a vehicle, generally denoted 10, for the curbside collection of source separated recyclable materials. The vehicle comprises a wheel-supported understructure 12, the front section of which receives a driver compartment 14 and the rear section of which supports a dumping unit 16.

The dumping unit 16 includes a box-like frame consisting of a front wall 18, a top wall 20, a rear wall 22, a bottom wall 23 (see FIG. 3) and opposite side walls 24 and 26.

Figure 3:
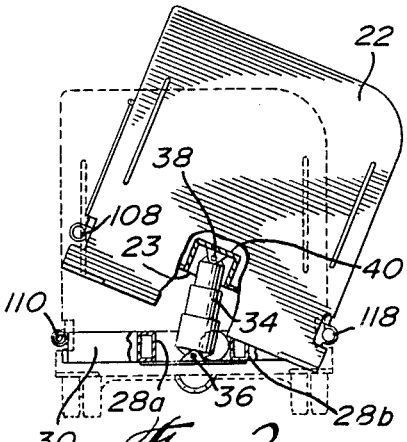
FIGS. 3 and 4 are end elevational views showing the box-like frame tilted in both directions.
Figure 4:
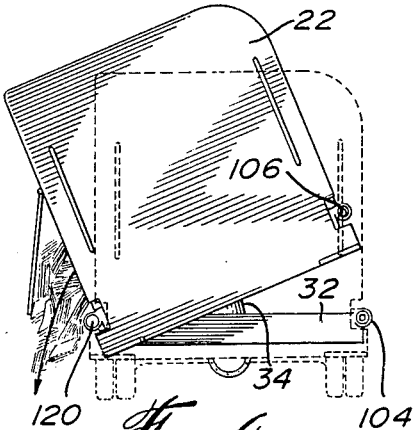
Figure 8:
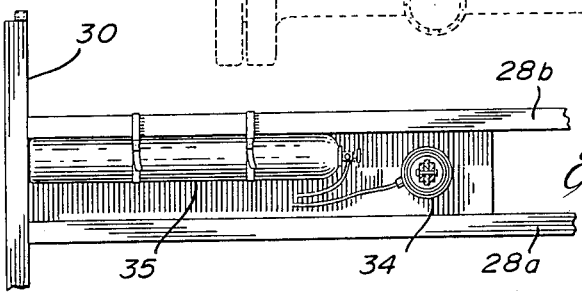
FIG. 8 is a plan view of the tilting mechanism mounted to the understructure of the vehicle.

Referring also to FIGS. 3 and 4, the understructure 12 comprises an elongated centrally extending frame 28 consisting of two longitudinal beams 28*a* and 28*b* having their opposite front and rear extremities fixedly connected to transverse frames 30 and 32. A cylinder 34 has its lower end pivotally connected at 36 to a frame plate (see FIG. 8) mounted to beams 28*a* and 28*b* and its upper end pivotally connected at 38 in a recessed area 40 of the bottom wall 23 of the frame.

Figure 5:
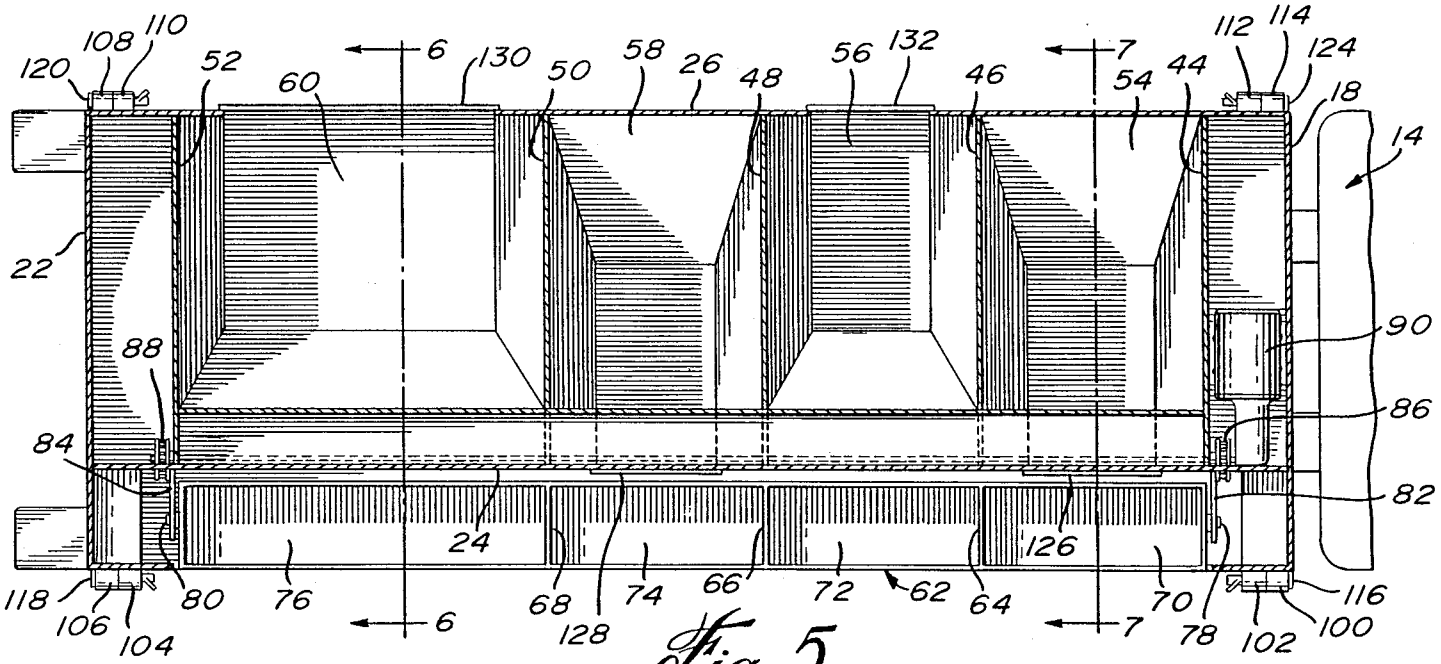
FIG. 5 is a top plan view of the box-like frame as seen from under the top wall thereof.

Referring to FIG. 5, the frame is formed of a series of longitudinally spaced dividing walls 44, 46, 48, 50 and 52 that define a series of compartments 54, 56, 58 and 60 which may be of varying dimensions.

An elongated trough 62 extends longitudinally of the frame adjacent side wall 24 thereof. This trough is formed of a series of longitudinally spaced dividing walls 64, 66, 68 that define a second series of compartments 70, 72, 74 and 76. As can be seen in FIG. 5, the width of these compartments correspond substantially to that of compartments 54, 56, 58 and 60, respectively.

Figure 6:
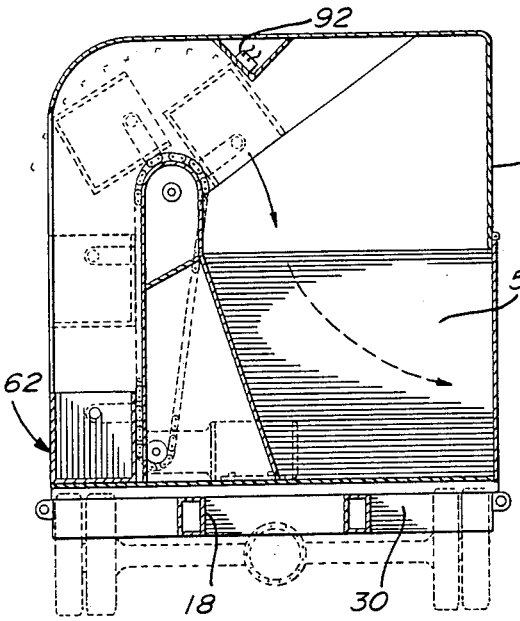
FIG. 6 is a cross-sectional view taken along lines 6—6 of FIG. 5.
Figure 7:
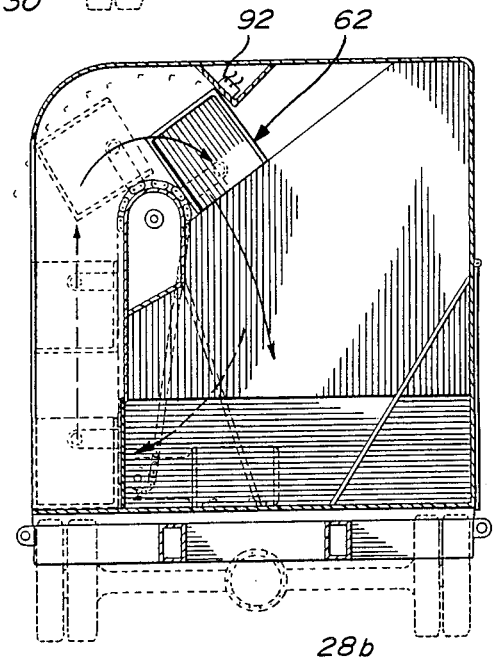
FIG. 7 is a cross-sectional view taken along lines 7—7 of FIG. 5.

The opposite extremities 78 and 80 of the trough are secured to arms 82 and 84 which, in turn, fixedly mounted to a pair of endless chains 86, 88 mounted on associated sprockets and driven by a motor 90. The trough is upwardly moved by means of the chain, sprocket and motor assembly from a material collecting position shown in FIG. 6 to a material discharging position shown in FIG. 7. The top wall 20 extends a distance above this discharging position and beyond the side wall 24 to enable the displacement of the trough. A limit switch 92 serves to stop the motor to allow the discharging of the recyclable materials from the compartment of the trough into the various compartments 54, 56, 58 and 60. Means (not shown) are provided to reverse the motor to return the trough to its initial material receiving position shown in FIG. 6.

Hinge points are provided at each lower corner of the frame at 100, 106, 108 and 114; they are in the shape of annular members adapted to come into registry with associated hinge points 102, 104, 110 and 112 provided at each outer extremity of the traverse beams 30 and 32 of the rear section of the understructure 12. Retaining pins 116, 118, 120 and 124 extend through corresponding pairs of hinge points to secure the box-like frame to the undertructure of the vehicle. These retaining pins are removable as explained below.

Each of the compartments 54, 56, 58 and 60 has, at its lower part, a latchable door 126, 128, 130, 132 hingedly mounted to the respective side walls 24, 26 of the vehicle.

In operation, recyclable materials collected at curbside are separated and deposited in the various compartments 70, 72, 74 and 76 of the trough. When desired, the trough is upwardly raised by actuating motor 90 causing the trough to be lifted to the discharging position shown in FIG. 7 where it is stopped by the limit switch 92. The operation of the motor is then reversed to return the trough to its initial loading position. At the dumping site, pins in the hinge points of the dumping side are kept in place while the pins on the other side are removed. The cylinder 34 is actuated causing the box to tilt about a pivot axis extending through the retained pins. The appropriate doors on that side of the vehicle being unlatched, the collected materials are therefore removed from their compartment and dispensed at their appropriate collecting location.

Although the invention has been described above in relation to one specific form, it will be evident to a person skilled in the art that it may be refined and modified in various ways. For example, the dividing walls in the box-like frame as well as in the trough can be made longitudinally adjustable to provide the flexibility of changing the capacity of the compartments and to allow daily variations in the volume of materials collected. Similarly, a door could be provided on the rear wall 22 to provide a rearward discharging of the contents in the rear compartment. However, in such case, the hinge points would require a construction different from that shown in the present embodiment to allow for rear tilting. Still, a pair of troughs of similar construction as trough 62 could be provided on both longitudinal sides of the box-like frame; in which case, means similar to the driving means and the moving means described above would be required to operate the additional trough. It is therefore wished to have it understood that the present invention should not be limited in interpretation except by the terms of the following claims.

The embodiments of the invention in which an exclusive property or privilege is claimed are defined as follows:

1. A vehicle for curbside collection of source separated recyclable materials comprising:

a wheel-supported understructure having front and rear sections;

a driver compartment mounted to said front section of said understructure;

a dumping unit mounted to said rear section of said understructure; said unit including a box-like frame having a front wall, a rear wall, spaced side walls, and a top wall, and displaying therein a plurality of longitudinally spaced dividing walls defining a first series of compartments;

a vertically movable trough extending longitudinally of said frame along one side wall thereof; said trough displaying therein a plurality of longitudinally spaced dividing walls defining a second series of compartments to receive source separated recyclable materials;

means on said unit for vertically guiding said trough along said one side wall; said guiding means allowing said trough to move to an upper discharging position over said side wall whereby recycling materials collected in each compartment of said trough are dumped into a corresponding compartment of said box-like frame;

actuatable means mounted between said frame and said understructure for moving said frame relative to said understructure;

hinge points on said frame and said understructure, located at the lower portion of each said side wall;

removable retaining means receivable in each said hinge point and cooperating with said actuatable means to tilt said frame about those hinge points from which said retaining means are not removed;

latchable door means at the bottom of each compartment of said frame allowing said materials to be discharged therefrom when said frame is tilted; and said top wall extends over said series of compartments and is disposed a distance above said one side wall to allow said trough to move to said upper discharge position.

2. A vehicle as defined in claim 1, further comprising drive means mounted on said understructure for actuating said actuatable means to tilt said dumping unit.

3. A vehicle as defined in claim 1, further comprising reversible drive means allowing said trough to move upwardly and downwardly along said one side wall of said frame.

4. A vehicle as defined in claim 3, further comprising limit switch means mounted on said frame for stopping the upward vertical movement of said trough at said discharging position.

5. A vehicle as defined in claim 2, wherein said actuatable means are located centrally of said understructure.

* * * * *